United States Patent [19]

Tymon

[11] 4,351,641

[45] Sep. 28, 1982

[54] CONTINUOUS DYEING OF PILE FABRICS

[75] Inventor: Thomas M. Tymon, Lancaster, Pa.

[73] Assignee: Armstrong World Industries, Inc., Lancaster, Pa.

[21] Appl. No.: 149,670

[22] Filed: May 14, 1980

[51] Int. Cl.[3] ..... D06P 1/00; D06P 3/00

[52] U.S. Cl. ..... 8/638; 8/639; 8/643; 8/929

[58] Field of Search ..... 8/638, 639, 643, 929

[56] References Cited

U.S. PATENT DOCUMENTS 4,213,759 7/1980 Ridyard et al. ..... 8/643

OTHER PUBLICATIONS

Jenkins, et al. Textile Chemist & Colorist 1/14/70, pp. 6–12.

Continuous Dyeing of Polyester Carpet, Dupont Bulletin No. 147 (12/70).

Olson, "Textile Chemist & Colorist" vol. 1, No. 9, Apr. 23, 1969, p. 35.

*Primary Examiner*—Maria Parrish Tungol

[57] ABSTRACT

A method for continuous dyeing of pile fabric using a Kusters dye applicator is disclosed. The method concerns the use of a dye solution comprising at least two dyestuffs, the dyestuffs being selected to have approximately equal strike rates, and a sufficient amount of a thickening agent to provide a dye solution-viscosity of from about 300 to about 1000 centipoise (Brookfield Viscometer). The resulting dyed carpet exhibits excellent shade uniformity in the across machine direction.

1 Claim, No Drawings

CONTINUOUS DYEING OF PILE FABRICS

This invention relates to the continuous dyeing of pile fabrics using a Kusters dye applicator.

More specifically, this invention pertains to continuous Kusters dyed pile fabric which exhibits uniform shade in the across machine direction.

Continuous dyeing of pile fabrics, such as carpets and upholstery fabric, using a Kusters dye applicator is well-known in the art. A typical Kusters dye applicator consists of a six inch diameter steel roll rotating in a trough of dye solution, with a doctor blade attachment to deliver the dye solution to the surface of the pile fabric.

Dye solutions employed in continuous Kusters dyeing often comprise two or more dyestuffs which inherently have different strike rates. One well-known production problem associated with the continuous Kusters dyeing of pile fabric using dye solutions containing two or more dyestuffs is non-uniform dye shade in the across machine direction of the pile fabric. Non-uniform dye shading in the across machine direction is referred to in the carpet industry as a "side match" problem because it is particularly visible where identically Kusters dyed carpet pieces, from even the same production run, are butt seamed together in the across machine direction.

The prior art pertaining to Kusters dyeing teaches that non-uniform dye shade across the pile fabric can best be controlled by selecting a combination of dyestuffs having approximately equal strike rates and formulating dye solutions to possess low viscosities, thus facilitating movement of the dye solution on the pile fabric prior to the dyes becoming completely fixed.

Typically, dye solutions to be overall applied to pile fabrics using a Kusters dye applicator are formulated to a viscosity of less than 100 centipoise, preferably, to a viscosity of from about 15 to about 80 centipoise (Brookfield Viscometer). See, for example, Dupont article reprints entitled "Continuous Dyeing of Carpets and Upholstery" and "Continuous Dyeing of Polyester Carpet" Bulletin No. 147, reprinted from the December 1969 and December 1970 *Dyes and Chemical Technical Bulletin,* respectively.

The above described prior art methods for controlling dye shade have not been completely satisfactory. For example, it is well known in the art that there seldom, if ever, exists a combination of dyestuffs which, when selected to have the needed physical properties such as lightfastness, wet fastness, ozone fastness, wet method cleaning resistance, etc., also possess equal strike rates. Accordingly, it has been found that careful dyestuff selection helps to minimize side match problems but, typically, does not serve to eliminate such problems.

The present invention provides a surprisingly simple and straightforward method for improving shade uniformity in the across machine direction of continuous Kusters dyed pile fabric. Thus, the method of this invention facilitates the production of continuous Kusters dyed pile fabric which can be butt seamed in the across machine direction. The method of this invention does follow the prior art teaching of selecting dyestuffs having approximately equal strike rates. However, the method of this invention also involves increasing dye solution viscosity in order to inhibit physical migration of the dyestuff combination. Accordingly, the method of this invention is contrary to the recognized prior art method or promoting movement, that is, reducing viscosity of the dye solution in order to control shade uniformity.

According to this invention there is provided a method for producing continuous dyed pile fabric comprising:

(a) passing the pile fabric through a wet out bath comprising a wetting agent and an agent for pH adjustment;

(b) applying, to the entire pile surface of the wetted out pile fabric, using a Kusters dye applicator, an aqueous dye solution comprising at least two dyestuffs, the dyestuffs being selected to have approximately equal strike rates, and a sufficient amount of thickening agent to provide a dye solution viscosity of from about 300 to about 1,000 centipoise (Brookfield Viscometer);

(c) steaming to fix the dyes on the pile fabric; and, (d) washing the pile fabric to remove chemicals and any unfixed dyes;

wherein the resulting dyed pile fabric exhibits more uniform shade in the across machine direction as compared to the uniformity of shade obtained using a Kusters dye applicator to apply said dye solution at a conventional Kusters applicator viscosity of less than about 100 centipoise (Brookfield Viscometer).

The method of this invention is specific to Kusters dyeing and is applicable to all dye solutions comprising two or more dyestuffs, which solutions are conventionally applied using a Kusters dye applicator. The dye solutions can comprise acid, cationic, or disperse dyestuffs, mixtures thereof and the like.

The following example illustrates the method of this invention.

EXAMPLE I

Two dye solutions were prepared by conventionally mixing the following amounts of ingredients:

| | Dye Solution (weight percent) | |
|---|---|---|
| Ingredients | (A) | (B) |
| Dyestuffs: | | |
| Acid Yellow | 0.042 | 0.042 |
| Acid Red | 0.025 | 0.025 |
| Acid Blue | 0.044 | 0.044 |
| Disperse Yellow | 0.077 | 0.077 |
| Disperse Red | 0.102 | 0.102 |
| Disperse Blue | 0.131 | 0.131 |
| Thickening Agent (Guar Gum) | 0.20 | 0.56 |
| Acetic Acid | 0.26 | 0.26 |
| Sodium Acetate | 0.05 | 0.05 |
| Surfactant (Dianol SWN)* | 0.3 | 0.3 |
| Water | Balance | Balance |

*Commercially available from Quaker Chemical

Dye solution A is a conventional Kusters dye solution. Dye solution A was tested and found to have a pH of 4.5 and a viscosity of 30 cps (Brookfield RVF Viscometer, #1 Spindle, 20 rpm at 25° C.).

Dye solution B is a dye solution according to the method of this invention. Dye solution B was tested and found to have a pH of 4.5 and a viscosity of 400 cps (Brookfield RVF Viscometer, #1 Spindle, 20 rpm at 25° C.).

Dye solution A and dye solution B were each separately applied to a nylon 6,6 multi level loop carpet using a Kusters dye applicator. The carpet had a low loop of 4/32", a high loop of 6/32", a gauge of 5/64", 25 stitches per 3", a pile weight of 20 ounces. The nylon was DuPont Antron III (1225 denier, 2 ply 754/757A).

The following table sets forth the results of the testing.

TABLE

| | Dye Solution | |
|---|---|---|
| | (A) Prior Art | (B) Invention |
| Total square yards of carpet dyed | 4,505 | 4,767 |
| Total square yards visually downgraded from perfect due non-uniformed shade sufficient to preclude side matching | 2,050 (or 45.5%) | 0 |

The above data indicate the excellent shade uniformity obtained by the method of this invention.

It will be evident from the foregoing that various modifications can be made to the invention. Such, however, are considered to be within the scope of the invention.

What is claimed is:

1. A method for producing continuous dyed pile fabric comprising:

(a) passing the pile fabric through a wet out bath comprising a wetting agent and an agent for pH adjustment;

(b) applying, to the entire pile surface of the wetted out pile fabric, using a Kusters dye applicator, an aqueous dye solution comprising at least two dyestuffs, the dyestuffs being selected to have approximately equal strike rates, and a sufficient amount of thickening agent to provide a dye solution viscosity of from about 300 to about 1,000 centipoise (Brookfield Viscometer);

(c) steaming to fix the dyes on the pile fabric; and, (d) washing the pile fabric to remove chemicals and any unfixed dyes;

wherein the resulting dyed pile fabric exhibits more uniform shade in the across machine direction as compared to the uniformity of shade obtained using a Kusters dye applicator to apply said dye solution at a conventional Kusters applicator viscosity of less than about 100 centipoise (Brookfield Viscometer).

* * * * *